United States Patent [19]

Yamasaki et al.

[11] Patent Number: 4,704,253

[45] Date of Patent: Nov. 3, 1987

[54] COPPER ALLOY FOR A RADIATOR FIN

[76] Inventors: Shinsuke Yamasaki, 3-18-35, Nakakokubun, Ichikawa City, Chiba Prefecture; Hajime Izumimori, 1359, Yonemoto, Yachiyo City, Chiba Prefecture, both of Japan

[21] Appl. No.: 816,961

[22] Filed: Jan. 8, 1986

Related U.S. Application Data

[63] Continuation-in-part of Ser. No. 586,706, Mar. 6, 1984, abandoned.

[30] Foreign Application Priority Data

Mar. 10, 1983 [JP] Japan ..... 58-39893

[51] Int. Cl.[4] ..... C22C 9/00

[52] U.S. Cl. ..... 420/499; 420/500; 148/411; 148/432

[58] Field of Search ..... 420/499, 500; 148/411, 148/432

[56] References Cited

U.S. PATENT DOCUMENTS 3,773,503 11/1973 Kranz et al. ..... 420/499
4,400,351 8/1983 Komori et al. ..... 420/499

FOREIGN PATENT DOCUMENTS 1027366 4/1966 United Kingdom ..... 420/499

*Primary Examiner*—L. Dewayne Rutledge
*Assistant Examiner*—George Wyszomierski
*Attorney, Agent, or Firm*—Watson, Cole, Grindle & Watson

[57] ABSTRACT

A copper alloy for use in the manufacture of a radiator fin contains 10 to 150 ppm of tellurium and 20 to 110 ppm of phosphorus, both by weight, as well as copper and unavoidable impurities.

4 Claims, 4 Drawing Figures

COPPER ALLOY FOR A RADIATOR FIN

This application is a continuation-in-part, of application Ser. No. 586,706, filed Mar. 6, 1984, now abandoned.

BACKGROUND OF THE INVENTION

1. Field of the Invention

The present invention relates to copper alloys, and more particularly to copper alloys which are useful in the fabrication of fins for automobile radiators.

2. Description of the Prior Art

The fins on automobile radiators are conventionally made of metallic materials which display high heat resistance, high thermal conductivity, high strength and high workability. With respect to the need that the metallic materials forming the fins display high heat resistance, this is in part due to the fact that the fins must be able to resist softening when they soldered to the radiator.

Over the past decade it has become increasingly important to automobile manufacturers to produce vehicles having reduced weights, and as a result manufacturers have sought ways to reduce the weights of the parts making up the automobiles, including the radiators therein. At the same time, it is desirable that the fins on the radiator provide an improved heat dissipating capacity per unit volume. In this regard, it has been considered desirable that the fins of automobile radiators be made of a material having a thermal conductivity of, say, at least 95%. IACS in terms of electrical conductivity, and a sufficient heat resistance to give a Vickers hardness of at least 110 after being heated at 350° C. for five minutes.

Copper alloys have previously been used (or proposed for use) in making radiator fins, these alloys containing a few percent of one or two elements selected from the group of tin, phosphorus, nickel, silver, cadmium, manganese and zinc. See, for example, the book by Allison Butts entitle "Copper, The Science & Technology of the Metal, Its Alloys and Compounds," Reinhold Publishing Corporation, New York (1954). On the other hand, copper alloys made of electrolytic copper and containing 0.01 to 0.08% by weight of tellurium are disclosed in Japanese Patent Publication No. 1706/1957, published on Mar. 15, 1957, and a copper alloy made of electrolytic copper and containing 0.03 to 1.0%, by weight of tellurium is disclosed in Japanese Patent Publication No. 5818/1976, published on Feb. 23, 1976. None of these alloys, however, display sufficient thermal conductivities and heat resistances to be useful in making radiator fins.

An object of the present invention is to provide a copper alloy which, when used to make radiator fins, will provide the fins with optimum physical properties, including high thermal conductivity and high heat resistance.

SUMMARY OF THE INVENTION

According to the present invention a copper alloy for use of radiator fins contains between 10 and 150 ppm by weight of tellurium and between 20 and 110 ppm by weight of phosphorus, the remainder consisting of copper and the normal, unavoidable impurities. Such impurities can include up to about 100 ppm of oxygen.

A better understanding of the invention will be had by reference to the attached drawings when considered with the following discussion.

BRIEF DISCUSSION OF THE DRAWINGS

FIG. 1 is a graph showing the heat resistance of a first copper alloy according to the present invention and comparative alloys which contain a total of about 60 ppm by weight of tellurium and phosphorus;

FIG. 2 is a graph showing the heat resistance of a second copper alloy according to the present invention and another comparative alloy containing a total of about 100 ppm by weight of tellurium and phosphorus; and FIGS. 3 and 4 are graphs of the tensile strength in lbs. per square inch as a function of heating temperature of the same alloys whose Vicker's Hardness as a function of heating temperature are shown in FIGS. 1 and 2.

DETAILED DESCRIPTION OF THE INVENTION

Figure 1:
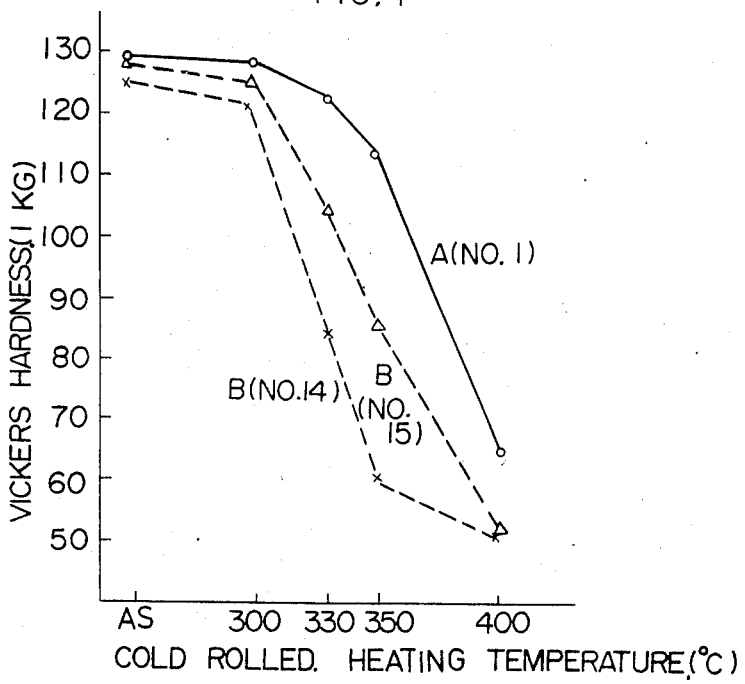

As noted above, the copper alloy according to the present invention contains between 10 and 150 ppm by weight of tellurium and between 20 and 110 ppm by weight of phosphorus. With respect to the tellurium content, it has been found that if less than 10 ppm is used, the copper alloy will not have a satisfactory heat resistance, whereas if more than 150 ppm is used, the copper alloy will not have a satisfactory thermal conductivity or workability (even though its heat resistance will be improved). With respect to the phosphorus content, if it falls below 20 ppm or exceeds 110 ppm, its synergistic action with the tellurium in providing a copper alloy having improved heat resistance and thermal conductivity will be very much reduced.

The invention copper alloys can contain oxygen in an amount of up to 100 ppm without reduction in their advantageous physical properties.

The alloy of this invention may be produced by employing tellurium in the form of, for example, metallic tellurium or a copper-tellurium compound, and phorphorus in the form of, for example, a copper-phosphorus alloy. There is no particular limitation to the process for melting the alloy and casting it into a fin, but it is possible to use any customary process.

The invention will now be described in further detail with reference to several examples thereof and comparative examples.

EXAMPLE 1

Electrolytic copper, metallic tellurium and a copper-phosphorus alloy were melted in a graphite crucible in a vacuum chamber. The molten product was cast into a mold in the vacuum chamber to form an ingot having a thickness of 20 mm, a width of 60 mm and a length of 100 mm. Eighteen ingots of different compositions were, thus, prepared as shown in TABLE 1. A surface layer having a thickness of 1 mm was removed from each surface of each ingot, and it was subjected to two or three passes of hot rolling at 850° C. to obtain a thickness of 10 mm. A specimen for a thermal conductivity test was formed from the hot rolled product. Then, a surface layer having a thickness of 1 mm was removed from each surface of the hot rolled product, and it was subjected to five passes of cold rolling for a thickness reduction from 8 mm to 3 mm, four pases from 3 mm to 1 mm, and three passes from 1 mm to 0.5 mm. A 20 mm square specimen for a heat resistance test was formed from the cold rolled product.

The themal conductivity of each specimen was determined in terms of its electrical conductivity (as electrical conductivity has a close positive correlation to its thermal conductivity). The heat resistance of each specimen was determined by measuring its Vickers hardness after it had been heated by immersion for five minutes in a salt bath containing equal weights of $NaNO_2$ and $NaNO_3$ and having a temperature of 300°, 330°, 350° or 400° C. The results of these tests are shown in TABLE 1. All of the specimens had an oxygen content below 10 ppm.

Figure 2:
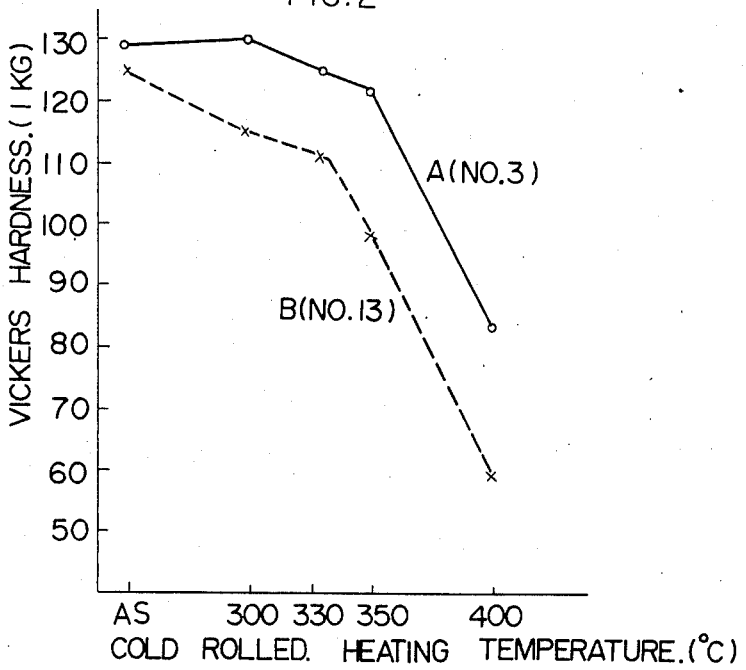

Several specimens of the alloys of this invention and the comparative alloys having an equal or approximately equal total content by weight of tellurium and phosphorus have been picked up from TABLE 1, and the results of their heat resistance tests are graphically shown in FIGS. 1 and 2. Curves A refer to the alloys of this invention, while curves B represent the comparative alloys. FIG. 1 compares the alloys having a total tellurium and phosphorus content by weight of about 60 ppm, while FIG. 2 deals with the alloys having a total tellurium and phosphorus content by weight of about 100 ppm.

As is obvious from TABLE 1 and FIGS. 1 and 2, the synergistic action of tellurium and phosphorus contributes greatly to improving the thermal conductivity and heat resistance of the alloy.

TABLE 1

| Specimen No. | Composition (ppm) Te | P | Cu | Electrical conductivity (% IACS) | Vickers hardness (1 kg) As cold rolled | Heating temperature 300° C. | 330° C. | 350° C. | 400° C. |
|---|---|---|---|---|---|---|---|---|---|
| Alloys of the invention | | | | | | | | | |
| 1 | 30 | 30 | Bal. | 101 | 129 | 128 | 122 | 113 | 64.2 |
| 2 | 30 | 50 | " | 101 | 130 | 129 | 123 | 115 | 68.6 |
| 3 | 55 | 45 | " | 100 | 129 | 130 | 125 | 122 | 83.0 |
| 4 | 50 | 70 | " | 99 | 130 | 130 | 128 | 120 | 86.3 |
| 5 | 20 | 100 | " | 98 | 132 | 128 | 124 | 117 | 69.4 |
| 6 | 110 | 30 | " | 99 | 127 | 125 | 120 | 113 | 102 |
| 7 | 50 | 105 | " | 97 | 129 | 132 | 129 | 125 | 92.0 |
| 8 | 90 | 70 | " | 97 | 129 | 130 | 130 | 128 | 110 |
| 9 | 110 | 100 | " | 96 | 132 | 135 | 133 | 130 | 118 |
| 10 | 140 | 70 | " | 97 | 130 | 132 | 131 | 128 | 112 |
| Comparative alloys | | | | | | | | | |
| 11 | 30 | — | " | 104 | 125 | 83.8 | 69.8 | 67.2 | 51.1 |
| 12 | 70 | — | " | 102 | 126 | 120 | 108 | 88.6 | 53.8 |
| 13 | 110 | — | " | 100 | 125 | 115 | 111 | 98.3 | 58.6 |
| 14 | — | 65 | " | 97 | 125 | 121 | 83.9 | 60.3 | 50.5 |
| 15 | 5 | 50 | " | 99 | 128 | 125 | 114 | 84.6 | 52.2 |
| 16 | 60 | 10 | " | 100 | 129 | 127 | 124 | 95.7 | 66.1 |
| 17 | 90 | 120 | " | 94 | 135 | 136 | 134 | 129 | 123 |
| 18 | 170 | 70 | " | 94 | 130 | 130 | 129 | 125 | 113 |

EXAMPLE 2

Electrolytic copper was high frequency melted in a graphite crucible in the open air, while the molten copper surface was covered with charcoal powder, and metallic tellurium and a copper-phosphorus alloy were added and melted in the molten copper. The molten alloy was cast into a mold to form an ingot having a thickness of 20 mm, a width of 60 mm and a length of 100 mm. Two ingots of different compositions were prepared as shown in TABLE 2. The procedures of EXAMPLE 1 were thereafter repeated. The results of the heat resistance and thermal conductivity test are shown in TABLE 2.

TABLE 2

| Specimen No. | Composition (ppm) Te | P | O | Cu | Electrical conductivity (% IACS) | Vickers hardness (1 kg) As cold rolled | Heating temperature 300° C. | 330° C. | 350° C. | 400° C. |
|---|---|---|---|---|---|---|---|---|---|---|
| 19 | 130 | 100 | 40 | Bal. | 95 | 127 | 121 | 118 | 114 | 66.5 |
| 20 | 60 | 100 | 50 | " | 96 | 125 | 120 | 116 | 113 | 64.9 |

As is obvious from TABLE 2, the alloy of this invention is satisfactory in thermal conductivity and heat resistance if it has a total oxygen content not exceeding 100 ppm, including oxygen in compound form and free oxygen.

EXAMPLE 3

In order to determine the tensile strengths of alloy samples 1–20 referred to in Tables 1 and 2, electrolytic copper, metallic tellurium and copper-phosphorus alloy were melted in a graphite crucible in a vacuum chamber. The molten product was cast into a vacuum mold to form an ingot having a thickness of 20 mm, a width of 60 mm and a length of 100 mm. The compositions of the ingots thus obtained are as shown in attached Table 3. A surface layer having a thickness of 1 mm was removed from each surface of each ingot and it was subjected to a hot rolling at 850° C. to obtain a thickness of 10 mm. Then a surface layer having a thickness of 1 mm was removed from each surface of the hot rolled product, and it was subjected to a cold rolling to obtain a thickness of 0.6 mm. A specimen for tensile strength test having a gauge length of 2 inches and a width of 0.5 inches was formed from the cold rolled product.

Figure 3:
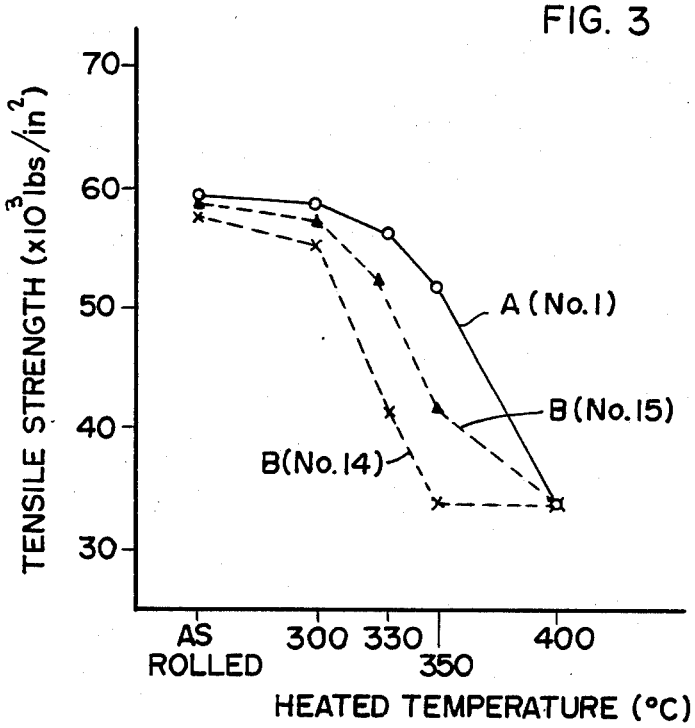

The tensile strength of each specimen was determined as cold rolled and again after it was held for 5 minutes in an electric oven in an argon atomsphere having a temperature of 300° C., 330° C., 350° C., and 400° C. The results are set forth in Table 3 and depicted in FIG. 3.

TABLE 3

| Specimen No. | Composition (ppm) Te | P | Cu | Tensile Strength (PSI) As cold rolled | Heating temperature 300° C. | 330° C. | 350° C. | 400° C. |
|---|---|---|---|---|---|---|---|---|
| Alloys of the invention | | | | | | | | |
| 1 | 30 | 30 | Bal. | 59,400 | 58,900 | 56,200 | 52,000 | 33,600 |
| 2 | 30 | 50 | " | 59,900 | 59,400 | 56,600 | 52,900 | 34,000 |
| 3 | 55 | 45 | " | 59,400 | 59,300 | 57,600 | 56,200 | 41,100 |
| 4 | 50 | 70 | " | 59,900 | 59,900 | 58,900 | 55,200 | 42,500 |
| 5 | 20 | 100 | " | 60,700 | 58,900 | 57,000 | 53,900 | 34,800 |
| 6 | 110 | 30 | " | 58,400 | 57,600 | 55,200 | 52,000 | 46,900 |
| 7 | 50 | 105 | " | 59,400 | 59,400 | 59,400 | 57,600 | 42,400 |
| 8 | 90 | 70 | " | 59,400 | 59,400 | 59,400 | 58,900 | 50,600 |
| 9 | 110 | 100 | " | 60,700 | 60,700 | 60,400 | 59,400 | 54,300 |
| 10 | 140 | 70 | " | 59,900 | 59,700 | 59,600 | 58,900 | 51,600 |
| Comparative alloys | | | | | | | | |
| 11 | 30 | — | " | 57,600 | 38,500 | 35,000 | 34,600 | 34,000 |
| 12 | 70 | — | " | 58,000 | 55,200 | 49,800 | 43,700 | 33,000 |
| 13 | 110 | — | " | 57,600 | 52,900 | 51,000 | 45,200 | 33,300 |
| 14 | — | 65 | " | 57,600 | 55,700 | 41,500 | 34,000 | 33,700 |
| 15 | 5 | 50 | " | 58,900 | 57,600 | 52,500 | 41,800 | 33,800 |
| 16 | 60 | 10 | " | 59,400 | 58,400 | 57,000 | 46,800 | 34,400 |
| 17 | 90 | 120 | " | 62,100 | 61,900 | 61,600 | 59,400 | 56,600 |
| 18 | 170 | 70 | " | 59,900 | 59,700 | 59,400 | 57,600 | 52,000 |

EXAMPLE 4

Electrolytic copper was high frequency melted in a graphite crucible in the open air, while the molten copper surface was covered with charcoal powder, and metallic tellurium and a copper-phosphorus alloy were added and melted in the molten copper. The molten alloy was cast into a mold to form an ingot having a thickness of 20 mm, a width of 60 mm and a length of 100 mm.

Figure 4:
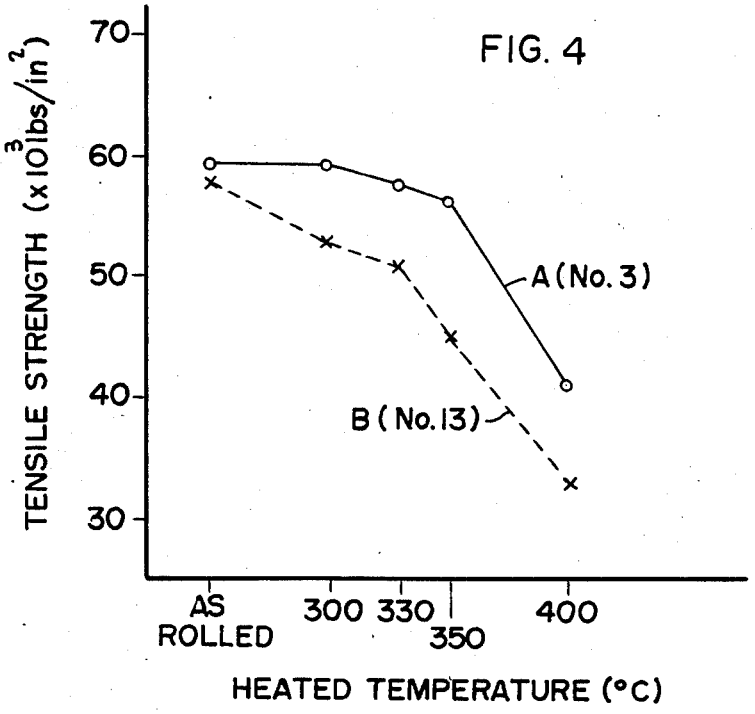

The compositions of the ingots thus obtained are as shown in attached Table 4. The procedures of EXAMPLE 3 were thereafter repeated. The results of the tensile strength test are set forth in attached Table 4 and depicted in FIG. 4.

TABLE 4

| Specimen No. | Composition (ppm) Te | P | O | Cu | Tensile Strength (PSI) As cold rolled | Heating temperature 300° C. | 330° C. | 350° C. | 400° C. |
|---|---|---|---|---|---|---|---|---|---|
| 19 | 130 | 100 | 40 | Bal. | 61,000 | 59,800 | 59,700 | 59,500 | 54,700 |
| 20 | 60 | 100 | 50 | " | 59,500 | 59,500 | 59,400 | 57,600 | 42,600 |

What is claimed is:

1. A copper alloy which consists of 10 to 150 ppm by weight of tellurium, 20 to 110 ppm by weight of phosphorus and up to 100 ppm by weight of oxygen, the balance being copper and unavoidable impurities.

2. A copper alloy as defined in claim 1, wherein said oxygen is present in an amount of below 10 ppm by weight.

3. A copper alloy as defined in claim 1, wherein said copper alloy has been annealed at 400° C. for 5 minutes and displays a minimum tensile strength of 33,600 psi.

4. A radiator fin which consists of 10 to 150 ppm by weight of tellurium, 20 to 110 ppm by weight of phosphorus and up to 100 ppm by weight of oxygen, the balance being copper and unavoidable impurities.

* * * * *